US006830674B2

(12) United States Patent
Ludwig et al.

(10) Patent No.: US 6,830,674 B2
(45) Date of Patent: Dec. 14, 2004

(54) BRIGHTENER ADDITIVE AND BATH FOR ALKALINE CYANIDE-FREE ZINC ELECTROPLATING

(75) Inventors: Robert J. Ludwig, Brunswick, OH (US); William E. Rosenberg, Berea, OH (US)

(73) Assignee: Columbia Chemical Corporation, Brunswick, OH (US)

( * ) Notice: Subject to any disclaimer, the term of this patent is extended or adjusted under 35 U.S.C. 154(b) by 10 days.

(21) Appl. No.: 10/288,113

(22) Filed: Nov. 5, 2002

(65) Prior Publication Data

US 2004/0084322 A1 May 6, 2004

(51) Int. Cl.[7] ..... C25D 3/22; C23C 18/00

(52) U.S. Cl. ..... 205/311; 205/309; 205/314

(58) Field of Search ..... 205/309, 311, 205/314; 106/1.29

(56) References Cited

U.S. PATENT DOCUMENTS

| | | | | | |
|---|---|---|---|---|---|
| 3,824,158 | A | | 7/1974 | Rosenberg | 205/55 R |
| 3,869,358 | A | | 3/1975 | Nobel et al. | 204/55 Y |
| 3,954,575 | A | | 5/1976 | Yanagida et al. | 205/55 R |
| 4,157,388 | A | | 6/1979 | Christiansen | 424/70 |
| 5,435,898 | A | * | 7/1995 | Commander et al. | 205/245 |
| 6,652,728 | B1 | * | 11/2003 | Sonntag et al. | 205/143 |
| 2002/0193264 | A1 | * | 12/2002 | Cannell et al. | 510/119 |
| 2004/0071746 | A1 | * | 4/2004 | Popplewell et al. | 424/401 |

FOREIGN PATENT DOCUMENTS

| | | |
|---|---|---|
| DE | 198 40 019 | 3/2000 |

* cited by examiner

*Primary Examiner*—Edna Wong
(74) *Attorney, Agent, or Firm*—Hudak, Shunk & Farine Co. LPA

(57) ABSTRACT

An aqueous alkaline non-cyanide zinc electroplating bath containing zinc ions for producing bright electrodeposits of zinc and a brightening agent comprising a polymeric quaternary amine and a reducing sugar, and a compound that forms a reducing sugar upon hydrolysis.

22 Claims, No Drawings

BRIGHTENER ADDITIVE AND BATH FOR ALKALINE CYANIDE-FREE ZINC ELECTROPLATING

FIELD OF THE INVENTION

The present invention relates to aqueous alkaline non-cyanide zinc plating baths, and to a novel brightening agent for such electroplating baths.

BACKGROUND OF THE INVENTION

This invention relates to improvements in the electrodeposition of zinc from aqueous alkaline cyanide-free plating baths. The alkaline cyanide-free zinc plating baths that have been developed over the years are generally based on polymeric quaternary amines as brightening agents. U.S. Pat. No. 3,824,158 describes an aqueous alkaline zinc electroplating bath containing an epihalohydrin quaternary salt of aminated polyepichlorohydrin. U.S. Pat. No. 3,869,358 describes an aqueous alkaline zinc plating bath for electroplating bright metallic zinc deposits having dissolved therein a water soluble reaction product of an amine and an epihalohydrin containing recurring tertiary and/or quaternary amine groups. U.S. Pat. No. 3,954,575 describes an alkaline non-cyanide zinc plating bath wherein the brightener additive comprises a water soluble polymer prepared by the reaction of at least one epihalohydrin with at least one nitrogen heterocyclic compound. U.S. Pat. No. 5,435,898 describes an aqueous bath for electrodepositing zinc and zinc alloys wherein the bath contains an effective additive amount of a quaternary ammonium polymer to produce enhanced deposits. German Patent DE 198 40 019 C 1 describes a brightener for alkaline cyanide-free zinc plating comprised of a ureylene quaternary ammonium polymer.

When polymeric quaternary amines are used as brightener additives in an aqueous alkaline cyanide-free zinc plating bath, metal hydroxides on the surface of the parts to be plated cause the electrodeposit to have a cloudy, dull appearance. Accordingly, complexing agents such as salts of gluconic acid and E.D.T.A. are added to the baths to overcome the detrimental effects of the presence of metal hydroxides. While this solves the problem of cloudy, dull electrodeposits, precipitation of metals during waste treatment becomes quite difficult.

SUMMARY OF THE INVENTION

An object of the present invention is to provide an aqueous alkaline cyanide-free zinc electroplating bath that produces bright electrodeposits of zinc.

It is a further object of the present invention to provide bright, clear electrodeposits of zinc in the presence of metal hydroxides on the surface of the parts.

Another object of the present invention is to provide an aqueous alkaline cyanide-free zinc electroplating bath that produces bright, clear electrodeposits of zinc without interfering with the precipitation of metals during waste treatment.

These and other objects and advantages will be apparent from the following description.

These objects and advantages are achieved by the addition of a reducing sugar to an aqueous alkaline cyanide-free zinc electroplating bath having a polymeric quaternary amine dissolved therein. The polymeric quaternary amines of this invention are well known in the plating industry and include epihalohydrin reaction products with various amines, quaternized polyethyleneimines, and ureylene quaternary ammonium polymers. The electrodeposits achieved are bright and are produced in the presence of metal hydroxides on the surface of the parts to be plated. Moreover, the improved baths of this invention have an advantage over baths of the prior art in that they readily permit the precipitation of metals during waste treatment procedures.

DETAILED DESCRIPTION

Aqueous alkaline cyanide-free zinc electroplating baths are well known in the art and have been widely used for many years. By the term alkaline cyanide-free it is meant that the bath is essentially free of sodium cyanide salts. In general, an aqueous alkaline cyanide-free zinc electroplating bath comprises a zinc compound and an alkali hydroxide. The source of zinc may be any soluble zinc compound and is usually zinc oxide and the base is usually sodium hydroxide or potassium hydroxide. The predominate zinc species in the bath at high pH ranges is believed to be the zincate ion. It is to be understood that as used herein, the "zinc ion" includes zincate or other ionic species of zinc useful in electroplating baths for electroplating metallic zinc therefrom. The amount of dissolved zinc is generally from about 3 to about 40 g/l and desirably from about 5 to about 25 g/l and the amount of the alkaline hydroxide is generally from about 50 to about 200 g/l and desirably from about 75 to about 165 g/l.

The polymeric quaternary amines of this invention vary widely. As a general requirement, they are soluble in the plating bath and have a brightening effect during electrodeposition. The group of polymeric quaternary amines include such compounds as the reaction of an epihalohydrin with a nitrogen heterocylclic compound as described in U.S. Pat. No. 3,954,575, an ephihalohydrin quaternary salt of aminated polyepichlorohydrin as described in U.S. Pat. No. 3,824,158, and the reaction product of an amine with an epihalohydrin producing a compound containing recurring tertiary and/or quaternary amine groups as described in U.S. Pat. No. 3,869,358, all hereby fully incorporated by reference. Polymeric quaternary amines disclosed in part in U.S. Pat. No. 4,157,388 and German Patent DE 198 40 019 C1 have the following general formulas:

Formula A

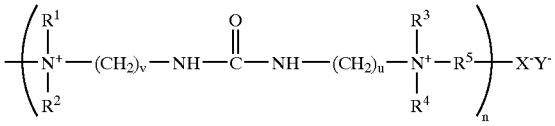

And

Formula B

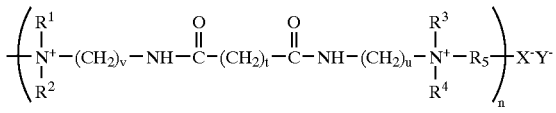

And

Formula C

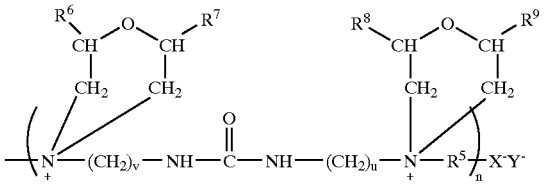

Wherein $R^1$, $R^2$, $R^3$, and $R^4$ independently, can be the same or different and includes $—CH_3$, $—CH_2CH_3$, $—CH(CH_3)_2$, or $—CH_2CH_2OH$, and wherein $R^5$ is $—CH_2CH_2—$, $—CH_2CH_2CH_2—$, $—CH_2CH_2CH_2CH_2—$, $—CH_2CHOHCH_2—$, or $—CH_2CH_2OCH_2CH_2—$, and wherein X and Y can be the same or different and include Cl, Br, and I, and wherein v, u, and t can be the same or different and each can be from 1 to about 7, and wherein $R^6$, $R^7$, $R^8$, and $R^9$, independently, can be the same or different and include —H, $—CH_3$, $—CH_2CH_3$, $—CH(CH_3)_2$, and $—CH_2CH_2OH$, and n is 2 to about 200.

The preferred polymeric quaternary amine of this invention are Mirapol WT and Mirapol AD-1 manufactured by Rhone-Poulenc. The Mirapol WT is represented in the above general Formula A wherein $R^1$, $R^2$, $R^3$, and $R^4$ are $CH_3$, $R^5$, is $—CH_2CH_2OCH_2CH_2—$, v and u are 3, X and Y are Cl, and n is an average of about 6. The Mirapol AD-1 is represented in the above general Formula B wherein $R^1$, $R^2$, $R^3$, and $R^4$ are $CH_3$, $R^5$ is $—CH_2CH_2OCH_2CH_2—$, v, u, and t are 3, X and Y are Cl and n=100. The CAS Number for Mirapol WT is 68555-36-2 and for Mirapol AD-1 is 90624-75-2.

The polymeric quaternary amines are used herein by employing them in amounts generally from about 0.1 g/l to 10 g/l and preferably from about 0.5 g/l to about 3 g/l in the bath.

During the process of cleaning steel parts before electroplating, a thin film of hydrated iron oxides are formed on the surface of the parts. Although it is not understood how, the hydrated iron oxides interfere with the brightening ability of the polymeric quaternary amines used as brightening agents. When the hydrated iron oxides are present on the surface a dull pattern of electroplated zinc is initially formed. Since aqueous alkaline cyanide-free zinc electroplating baths do not have much leveling ability, the dull pattern of initially deposited zinc can be observed even after a thick layer of bright zinc is deposited over it.

The presence of a reducing sugar removes the thin film of hydrated iron oxides prior to electrodeposition by either reducing the iron cation and thus forming a soluble hydroxide or by selectively dissolving the hydrated iron oxides. Whichever the case, a clean film-free part surface is produced eliminating the initial dull deposition of zinc.

The reducing sugars are well documented. Reducing sugars are carbohydrates that are easily oxidized by mild oxidizing agents. Sugars such as glucose and fructose are reducing sugars.

If a sugar reduces Tollens' reagent from $Ag(NH_3)_2^+$ to metallic silver, or if it reduces Fehling's solution from $Cu(NH_3)_4^{++}$ to red cuprous oxide, it is said to be a reducing sugar. Examples of the reducing sugars of this invention include fructose, ribose, arabinose, xylose, lyxose, allose, altrose, glucose, gulose, mannose, idose, galactose, talose, glucosamine hydrochloride, and lactose.

The reducing sugars are used by employing them in amounts generally from about 0.5 g/l to 20 g/l and preferably from about 1 g/l to about 10 g/l.

The plating bath of this invention can also contain additives of the type conventionally employed in alkaline cyanide-free zinc electroplating baths and include one or more materials such as polymeric amines, gelatin, glues, peptone, thiourea, p-methoxybenzaldehyde, heliotropine, veratraldehyde, vanillin, and N-benzyl-3-carboxypyridinium chloride-sodium salt, and the reaction products of epichlorohydrin, formaldehyde and amines.

The quaternary amine polymers and reducing sugars can be added separately to the plating bath by first dissolving them in a suitable solvent such as water. It is often desirable to make a concentrated mixture of the above additives in a suitable solvent and add this mixture to the bath instead of adding them separately. In general this mixture of brighteners, or brightener, contains from about 2 to 50 percent by weight of the polymeric quaternary amine and from about 1 to 20 percent by weight of the reducing sugar the remainder being suitable solvent such as water. The mixture of brighteners, or brightener, may also contain from about 0.5 to 30 percent by weight of additives conventionally employed in alkaline cyanide-free zinc electroplating baths as set forth herein above and fully incorporated by reference such as polymeric amine, gelatin, glues, peptone, etc.

In order to further illustrate the composition and process of the present invention, the following examples are provided. It is understood that the examples are provided for illustrative purposes and are not intended to limit the scope of the present invention as herein described and as set forth in the claims.

EXAMPLES

Example 1

| | |
|---|---|
| Zinc Ions | 12 g/l |
| Sodium Hydroxide | 120 g/l |
| Mirapol WT (62% by wt.) | 2.0 g/l |
| N-Benzyl-3-carboxypyridinium Chloride, sodium salt | 0.02 g/l |
| D-glucose | 5.0 g/l |

Example 2

| | |
|---|---|
| Zinc Ions | 11 g/l |
| Sodium Hydroxide | 135 g/l |
| Reaction Product of Epichlorohydrin and N-dimethylaminopropylamine as shown in Procedure 1 in U.S. Pat. No. 3,869,358 | 4.0 |
| N-Benzyl-3-carboxypyridinium Chloride, sodium salt | 0.03 g/l |
| Fructose | 4.0 g/l |

Example 3

| | |
|---|---|
| Zinc Ions | 10 g/l |
| Sodium Hydroxide | 100 g/l |
| Mirapol AD-1 (62% by wt.) | 2.0 g/l |
| N-Benzyl-3-carboxypyridinium Chloride, sodium salt | 0.02 g/l |
| Lactose | 6.0 g/l |

Example 4

| | |
|---|---|
| Zinc Ions | 7.5 g/l |
| Sodium Hydroxide | 90 g/l |
| Mirapol AD-1 (62% by wt.) | 3.0 g/l |
| p-Methoxybenzaldehyde, sodium bisulfite adduct | 0.04 g/l |
| Fructose | 6.0 g/l |

Hull Cell tests were run on each of the above baths at 1 ampere for 5 minutes on zinc plated steel test panels that were stripped in 30% hydrochloric acid, rinsed and wiped with a clean wet paper towel before plating. For comparison, test baths were prepared as above but without the reducing sugars. 1 ampere, 5 minute test panels were run as above with the test panel preparation being the same. In comparing the results, the baths containing the reducing sugars produced brighter, cloud-free electrodeposits of zinc compared to the baths that did not contain the reducing sugars which produced dull, cloudy electrodeposits of zinc.

Waste treatment tests were performed by making 1 percent by volume solutions in water of the bath from Example 1 to simulate rinse water from commercial zinc electroplating operations. To see if the bath ingredients interfere with the precipitation of metals, 100 ppm of $Ni^{++}$ as nickel sulfate, and 100 ppm of $Cu^{++}$ as copper sulfate were added separately to the simulated rinse water samples. The solutions were adjusted to pH=9 with a 50% solution of sulfuric acid as is normally done during waste treatment to precipitate the insoluble metal hydroxides. The solutions were then filtered and analyzed by atomic absorption spectroscopy to determine the amount of metals left in solution. For comparison these tests were repeated with the bath of Example 1 except that equal amounts, i.e. 5.0 g/l each of E.D.T.A. tetrasodium salt, and sodium gluconate were substituted for the D-glucose. Chart 1 shows the results of the analysis of the filtrates.

CHART 1

Results of Waste Treatment Tests

| 1% Solution | No metal added | 100 ppm Ni++ added | 100 ppm Cu++ added |
|---|---|---|---|
| Bath from Example 1 with D-glucose | Zn++ = 0.1 ppm | Ni++ = less than 0.2 ppm | Cu++ = 0.05 ppm |
| Bath from Example 1 with E.D.T.A. Tetrasodium salt | Zn++ = 8.0 ppm | Ni++ = 1.1 ppm | Cu++ = 5.0 ppm |
| Bath from Example 1 with Sodium Gluconate | Zn++ = 0.3 ppm | Ni++ = 2.0 ppm | Cu++ = 0.05 ppm |

It can be seen from Chart 1 that E.D.T.A. tetrasodium salt and sodium gluconate interfere with the precipitation of metal hydroxides from electroplating rinses and an equal amount of D-glucose does not.

While in accordance with the patent statutes the best mode and preferred embodiment have been set forth, the scope of the invention is not intended to be limited thereto, but only by the scope of the attached claims.

What is claimed is:

1. An aqueous alkaline non-cyanide zinc electroplating bath, comprising:

zinc ions, a polymeric quaternary amine, and a reducing sugar.

2. The bath of claim 1, wherein said polymeric quaternary amine has the formula:

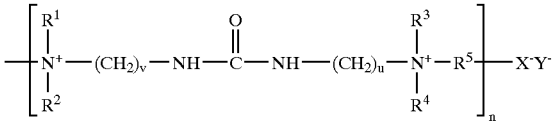

or,

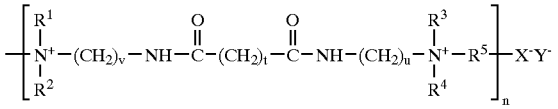

or,

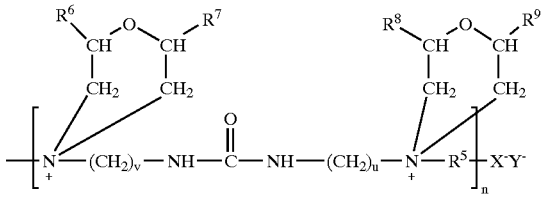

or combinations thereof, wherein $R^1$, $R^2$, $R^3$, and $R^4$, independently, are the same or different and include $—CH_3$, $—CH_2CH_3$, $—CH(CH_3)_2$, or $—CH_2CH_2OH$, wherein $R^5$ is $—CH_2CH_2—$, $—CH_2CH_2CH_2—$, $—CH_2CH_2CH_2CH_2—$, $CH_2CHOHCH_2—$, or $—CH_2CH_2OCH_2CH_2—$, wherein X and Y can be the same or different and include Cl, Br, and I, wherein v, u, and t can be the same or different and each can be from 1 to about 7, wherein $R^6$, $R^7$, $R^8$, and $R^9$, independently, are the same or different and include $—H$, $—CH_3$, $—CH_2CH_3$, $—CH(CH_3)_2$, or $—CH_2CH_2OH$, and wherein n is 2 to about 200.

3. The bath of claim 2, wherein said reducing sugar comprises fructose, ribose, arabinose, xylose, lyxose, allose, altrose, glucose, gulose, mannose, idose, galactose, talose, glucosamine hydrochloride, or lactose, or combinations thereof.

4. The bath of claim 3, including at least one compound comprising a polymeric amine, gelatin, glue, peptone, thiourea, p-methoxybenzaldehyde, heliotropine, veratraldehyde, vanillin, N-benzyl-3-carboxypyridinium chloride-sodium salt, or the reaction product of epichlorohydrin, formaldehyde and an amine.

5. The bath of claim 4, wherein said polymeric quaternary amine has the formula:

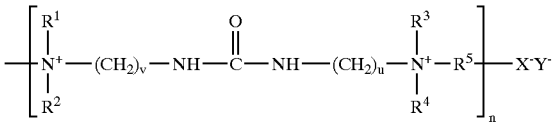

where $R^1$, $R^2$, $R^3$, and $R^4$ are $—CH_3$, $R^5$ is $—CH_2CHOCH_2CH_2—$, u and v are the same and are 3, X and Y are Cl, and n is 6.

6. The bath of claim 4, wherein said polymeric quaternary amine has the formula:

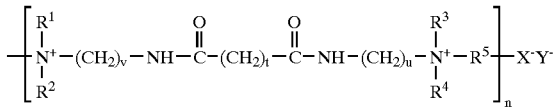

where $R^1$, $R^2$, $R^3$, and $R^4$ are $—CH_3$, $R^5$ is $—CH_2CH_2OCH_2CH_2—$, u, v, and t are the same and are 3, X and Y are Cl, and n is 2 to about 200.

7. The bath of claim 4, wherein said polymeric quaternary amine has the formula:

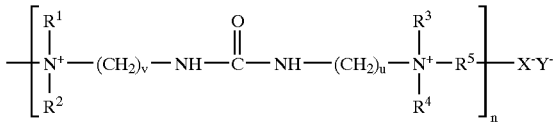

where $R^1$, $R^2$, $R^3$, and $R^4$ are $—CH_3$, $R^5$ is $—CH_2CH_2CH_2—$, u and v are the same and are 3, X and Y are the same or different and are Cl, Br, or I, and n is 2 to about 200.

8. The bath of claim 4, wherein said polymeric quaternary amine is dissolved therein in an amount from about 0.1 to about 10 g/l.

9. The bath of claim 8, wherein said reducing sugar is dissolved therein in an amount from about 0.5 to about 20 g/l.

10. The bath of claim 4, wherein said polymeric quaternary amine polymer is dissolved therein in an amount from about 0.5 to about 3 g/l.

11. The bath of claim 10, wherein said reducing sugar is dissolved therein in an amount from about 1 to about 10 g/l.

12. The bath of claim 2, wherein said reducing sugar is D-glucose.

13. The bath of claim 2, wherein said reducing sugar is fructose.

14. The bath of claim 2, wherein said reducing sugar is lactose.

15. A brightener composition for electrodeposits of zinc from an aqueous alkaline plating bath, comprising:

from about 2% to about 50% by weight of a polymeric quaternary amine, and from about 1% to about 20% by weight of a reducing sugar, and the remainder being a suitable solvent;

wherein said polymeric quaternary amine has the formula:

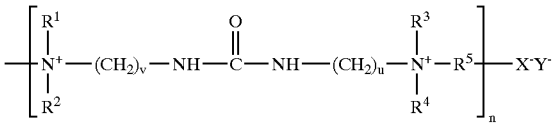

wherein $R^1$, $R^2$, $R^3$, and $R^4$, independently, are the same or different and include $—CH_3$, $—CH_2CH_3$, $—CH(CH_3)_2$, or $—CH_2CH_2OH$, wherein $R^5$ is $—CH_2CH_2—$, $—CH_2CH_2CH_2—$, $—CH_2CH_2CH_2CH_2—$, $—CH_2CHOHCH_2—$, or $—CH_2CH_2OCH_2CH_2—$, wherein X and Y are the same or different and includes Cl, Br, or I, wherein y, and u, are the same or different and each independently are from 1 to about 7, wherein n is 2 to about 200.

16. The brightener composition of claim 15, further including from about 0.5% to about 30% by weight of at least one compound comprising a polymeric amine, gelatin, glue, peptone, thiourea, p-methoxybenzaldehyde, heliotropine, veratraldehyde, vanillin, N-benzyl-3-carboxypyridinium chloride-sodium salt, or the reaction product of epichlorohydrin, formaldehyde and an amine.

17. The brightener composition of claim 16, wherein:

the reducing sugar comprises fructose, ribose, arabinose, xylose, lyxose, allose, altrose, glucose, gulose, mannose, idose, galactose, talose, glucosamine hydrochloride, or lactose.

18. The brightener composition of claim 17, wherein in said polymeric quaternary amine formula, $R^1$, $R^2$, $R^3$, and $R^4$ are $—CH_3$, $R^5$ is $—CH_2CH_2OCH_2CH_2—$, u and v are the same and are 3, X and Y are Cl, and n is about 6.

19. The brightener composition of claim 17, wherein in said polymeric quaternary amine formula, $R^1$, $R^2$, $R^3$, and $R^4$ are $—CH_3$, $R^5$ is $—CH_2CH_2CH_2—$, u and v are the same and are 3, X and Y are the same or different and are Cl, Br, or I, and n is 2 to about 200.

20. The brightener composition of claim 15, wherein said reducing sugar is D-glucose.

21. The brightener composition of claim 15, wherein said reducing sugar is fructose.

22. The brightener composition of claim 15, wherein said reducing sugar is lactose.

* * * * *

UNITED STATES PATENT AND TRADEMARK OFFICE

CERTIFICATE OF CORRECTION

PATENT NO. : 6,830,674 B2
DATED : December 14, 2004
INVENTOR(S) : Robert J. Ludwig and William E. Rosenberg It is certified that error appears in the above-identified patent and that said Letters Patent is hereby corrected as shown below:

Column 8,
Line 17, the letters “y”, and “u”, should be -- “v”, and “u” --.

Signed and Sealed this

Nineteenth Day of April, 2005

JON W. DUDAS
*Director of the United States Patent and Trademark Office*